US006282926B1

(12) United States Patent
Matsuda et al.

(10) Patent No.: US 6,282,926 B1
(45) Date of Patent: Sep. 4, 2001

(54) FASTENING DEVICE WITH TAPE

(75) Inventors: Yoshio Matsuda; Shunji Akashi; Kiyomasa Segawa, all of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/483,780

(22) Filed: Jan. 18, 2000

(30) Foreign Application Priority Data

Jan. 29, 1999 (JP) ..... 11-022972

(51) Int. Cl.[7] ..... D04B 23/08
(52) U.S. Cl. ..... 66/192; 66/195
(58) Field of Search ..... 66/193, 195, 190, 66/192, 196; 24/392, 393

(56) References Cited

U.S. PATENT DOCUMENTS

| | | | | |
|---|---|---|---|---|
| 2,821,765 | * | 2/1958 | Leahy et al. | 24/142 |
| 4,228,566 | | 10/1980 | Matsuda . | |
| 4,378,683 | * | 4/1983 | Matsuda et al. | 66/193 |
| 5,586,454 | * | 12/1996 | Matsuda et al. | 66/193 |
| 6,076,377 | * | 6/2000 | Ta-An | 66/193 |

FOREIGN PATENT DOCUMENTS

| | | |
|---|---|---|
| 2200444 | 7/1973 | (DE) . |
| 228293 | 7/1987 | (EP) . |
| 943255 | 9/1999 | (EP) . |
| 2413490 | 7/1979 | (FR) . |

* cited by examiner

*Primary Examiner*—Danny Worrell
(74) *Attorney, Agent, or Firm*—Finnegan, Henderson, Farabow, Garrett & Dunner, L.L.P.

(57) ABSTRACT

A tape of the fastening device made of synthetic resin is composed of an attachment area formed of one or more wales disposed at right and left edge portions of the tape in the width direction thereof and a fastener-molding area formed of plural wales in a center portion in the width direction. The warp knitted tape is entirely composed of a knitting structure formed by tangling of tricot stitch yarns and single cord stitch yarns, and chain stitch yarns are further knitted in the fastener-molding area so as to suppress stretching property in a warp direction of the area to a maximum extent and ensure a dimensional stability. The attachment area is composed of a knitting structure having required stretching property in its warp direction and some extent of stability in the dimensional form. Therefore, the fastening device with tape can be sewed to and along a curved line easily and can be adapted to an attachment object having stretching property well. Further, it allows engagement and disengagement of its fasteners securely and accurately, and enables continuous smooth molding of the fasteners made of synthetic resin onto the tape.

6 Claims, 7 Drawing Sheets

FASTENING DEVICE WITH TAPE

BACKGROUND OF THE INVENTION

1. Field of the Invention

The present invention relates to a fastening device with tape to which a fastener such as a male or female snap fastener made of thermoplastic resin material is integrally molded on and through front and rear surfaces of the tape. More particularly, it relates to a fastening device with tape which is a knitted tape having flexibility, some extent of stretching property, and form stability, and is ensured in dimensional stability during molding, and which is capable of following stretch of the attachment object sufficiently so that sewing on a curved portion can be neatly done.

2. Description of the Related Art

Most tapes to be used for a fastening device with tape, to which a fastener made of thermoplastic synthetic resin is attached integrally to the tape, are fabric woven with non-stretchable warp and weft yarns. The reason is that when the fasteners such as snap fasteners and eyelets are molded on a tape or the fastening device with tape is attached to an attachment object such as clothes, bag, curtain or the like, stability of the tape form is secured. Therefore, in general, the fastening device with tape has a low stretching property.

A production method for such a fastening device with tape has been disclosed in, for example, the U.S. Pat. No. 2,821,764. According to the production method, for a purpose of ensuring an excellent joining force between the tape and a grommet, a plurality of small holes are made around a mounting hole which is for mounting the grommet and inserting a tape, and the grommet to be molded integrally on front and rear surfaces of the tape through the mounting hole is fixed firmly with leg portions formed through those small holes. According to a specification of the U.S. patent, in order to prevent waving of a peripheral portion around the mounting hole of the tape or displacement of the tape in directions of the front and rear surfaces thereof, a plurality of pin members are provided inside a grommet-molding cavity formed in a movable die and a fixed die such that they are protruded into portions in which the peripheral portion around the mounting hole of the tape is inserted from each of inner faces of the cavities so as to oppose each other. Then, the peripheral portion around the mounting hole of the tape is clamped by the pin members. Under this condition, molten resin material is injected so as to mold the eyelet integrally around the mounting hole of the tape. Such a structure for preventing the waving has been also applied to a production method for a snap fastener with tape, which is disclosed in, for example, Japanese Patent Laid-Open Publication No. 62-155805.

According to Japanese Utility Model Laid-Open Publication No. 56-16311 and Japanese Patent Laid-Open Publication No. 10-33211, the tape is composed of woven fabric or knitted fabric, a fastener molding portion formed in a center in a width direction of the tape is formed by weaving or knitting coarsely, at least, and the snap fastener is molded integrally on that center portion. In this case, the mounting holes are not made in the fastener molding portion as in the aforementioned U.S. patent, but the snap fastener is molded integrally on the front and rear surfaces of the tape by introducing molten resin material through gaps between yarns woven or knitted coarsely in the tape.

The aforementioned synthetic resin fastening device with tape, which substitutes for a conventional fastening device with tape to which a metallic fastener is attached, is excellent to the touch as well as productivity. Thus, this is not only applied to the fastening devices in outer wears, various bags or the like, but also often used for foundation, inner wear, baby clothes, medical clothes or the like, which directly contacts the skin of man's body. On the other hand, recently, various fabric materials have been developed to meet diversified fashions. For example, there are used outer wear having a stretching property, various kinds of clothes made of fabric material having softness and an appropriate stretching property, knitted fabric or the like are used.

Usually, a woven tape as mentioned above is used for a tape of a synthetic resin fastening device with tape which is applied to clothes to be directly in contact with man's skin like foundation or the clothes made of peculiar fabric material. However, the woven fabric tape does not fit to such soft clothes having ample stretching property, so that it is likely to move individually between the clothes and the fasteners. Therefore, when the fastening device is engaged or disengaged, it is difficult to join a male and a female fasteners with fingers, or a finger force of the operation is difficult to transmit to each of the fasteners. As a result, it takes a long time to engage or disengage the both fasteners.

Even if, a flexible, thin woven tape is used, excellent stretching property cannot be expected. When this kind of the woven tape is attached to stretchable clothes or along a curved portion of the clothes, the tape is not capable of following the stretching of the stretchable clothes, the tape is wrinkled when it is sewn to the curved portion, or the curved portion of the sewing portion loses its shape.

As a tape material for a fastening device with tape which is suitable for attachment to a curved portion, Japanese Utility Model Publication No. 3040449 proposes use of bias woven fabric which is obtained by cutting warp and weft yarns obliquely at a predetermined angle. However, in the bias woven fabric, the yarns tend to be frayed at a cut end thereof. Therefore, according to the registered utility model, both edge portions in the width direction of the tape is folded back toward its center, and the synthetic resin snap fastener is molded integrally between those opposing edge portions.

Although use of a knitted tape has been described in the above mentioned Japanese Utility Model Laid-Open Publication No. 56-16311 and Japanese Patent Laid-Open Publication No. 10-33211, its concrete tape structure relating to a knitting structure, thickness of yarn to be used or the like has not been concretely proposed. In the synthetic resin fastening device with tape using the bias woven fabric tape as disclosed in the Japanese Utility Model Publication No. 3040449, no concrete method has been disclosed about a production method for the synthetic resin fastening device with tape, particularly a molding method for the fastening device.

Conventionally, as a tape material for the synthetic resin fastening device with tape of this kind, many attempts have been carried out in order to use stretchable tapes, such as a knitted tape using a stretching property based on its knitting structure, a woven tape using stretchable yarns as constitutive yarns of warp yarns. However, because many problems, that will occur when the synthetic resin fasteners are molded integrally on the tape, have not been overcome as described later, these tapes have not been reduced to practice. Even when the knitted tape is used, it is not capable of securing form stability as well as the woven tape. In order to secure this form stability, it is necessary to suppress that stretching property completely by, for example, coating the knitting structure. However, when the stretching property is suppressed completely, proper flexibility and stretching property of the knitted fabric are not exerted so that the above requirement cannot be satisfied.

In general, in production of this kind of synthetic resin fastening device with tape, a tape is inserted into a tape insertion passage in upper and lower dies formed with a molding cavity for molding a fastener, at facing portions thereof, and thermoplastic synthetic resin is injected into the cavity in molten state so as to mold the fastener on front and rear surfaces of the tape, as described above. In order to mold the fastener on the front and rear surfaces of the tape, generally a fastener-mounting hole is made in the center portion in the width direction of the tape, or the tape is knitted with a coarse knitting structure, in case where the molten resin is introduced into the cavity in the upper and lower dies disposed so as to sandwich the front and rear surfaces of the tape.

The aforementioned fastener is molded integrally by injecting molten resin material successively at a predetermined pitch to a long tape being transferred between the upper and lower dies intermittently. Mounting positions of the male and female fasteners on each tape need to be precise enough to correspond to each other in the synthetic resin fastening device with tape which acts in a pair as the male and female fastening device with tape as a product. That is, an error in pitch between the plural fasteners molded on the tape should be avoided.

However, although in case of the knitted fabric having stretching property, some extent of stretching property may be obtained easily due to its structure, it is difficult to obtain form stability which is a conflicting function to the stretch property. Thus, to mold plural fasteners continuously at an accurate pitch on front and rear surfaces of a knitted tape, not only a highly accurate control on a tape tension, transfer speed but also high positioning accuracy is required. To satisfy these requirements, a highly accurate control technology and equipment for such flexible material are necessary. However, even when these are technologically possible to be achieved, they cannot be carried out in economical viewpoints.

Particularly, when a fastening device with tape having low stretching property is sewed to and along a curved opening/closing portion of clothes, the tape may be wrinkled or the curve line of the opening/closing portion may lose its shape. To eliminate this disadvantage, use of the bias woven fabric as a tape, which is disclosed in the aforementioned Japanese Utility Model publication No. 3040449, can be considered. However, warp yarn and weft yarn tend to be loose at an edge portion of the bias woven fabric. Therefore, both the edge portions in the tape width direction are folded toward the center as described above, and a fastener is molded integrally along the opposing edge portions so as to prevent the yarns from being loose.

Therefore, the production method includes additional steps to ordinary production steps, for example, for producing a tape by bias-cutting a woven fabric, folding the tape back from the right and left along a longitudinal direction thereof and introducing the tape to an injection molding machine for molding a fastener. Therefore, not only production equipment necessarily increases but also productivity drops remarkably. Further, because a tape obtained by the bias-cut has a stretching property both in the warp and weft directions, it cannot be introduced into the injection molding machine at an accurate pitch. To carry out positioning of the tape, complicated mechanism and control are required. Further, the tape of the fastening device with tape as a product becomes cylindrical so that its form is not stabilized. When it is intended to sew the tape neatly, the sewing procedure becomes troublesome.

SUMMARY OF THE INVENTION

Accordingly, the present invention has been achieved to solve these problems, and therefore an object of the invention is to provide a fastening device with tape which is a warp knitted tape having dimensional stability and some extent of stretching property and which can be sewed easily and neatly along a curved opening/closing portion. Further, the object of the invention is to provide a fastening device with tape which can be engaged or disengaged securely even when the tape is sewed to clothes having ample flexibility and stretching property, and which enables continuous molding of a plurality of the fasteners integrally on the tape at a highly accurate pitch by using conventional production equipment.

To achieve the above object, according to a first aspect of the present invention, there is provided a fastening device with tape obtained by molding one or more fastener such as a snap fastener made of thermoplastic synthetic resin integrally on a tape, wherein the tape is composed of a warp knitting structure in which plural wales are disposed in a width direction of the tape, an area formed of one or more wales disposed at right and left edge portions in the width direction thereof is an attachment area to an attachment object, an area formed of plural wales in a center of the tape in the width direction thereof is a fastener-molding area, the attachment area a knitting structure having stretching property in the warp direction and stabilized to some extent in dimensional form, and the fastener-molding area has a knitting structure stabilized in dimensional form while stretching property in the warp direction is suppressed.

According to the fastening device with tape of the present invention, because a warp-knitted tape is used in which the fastener-molding area in the center portion in the width direction of the tape is composed of a knitting structure not having stretching property in the warp direction. Therefore, when the fasteners are molded continuously at a predetermined pitch in a longitudinal direction of the warp knitted tape, no disadvantage occurs in transferring the warp knitted tape intermittently and positioning the tape. Further, even when a conventional tape-transfer apparatus which has been used for a conventional woven tape is used, a high accurate positioning and transferring can be carried out.

When the fastening device with tape using the warp knitted tape of the present invention is sewed to a curved opening/closing portion of an attachment object such as clothes, the tape can be curved along the curved portion in the same plane, because the sewing line exists within the attachment areas having stretching property in the warp direction located at both the edge portions in the width direction of the tape. Thus, the sewing work is easy to be carried out and a neat sewing line can be formed. Further, the tape adapts itself to stretch of the clothes having stretching property well so that damages of the clothes due to sewing thread can be avoided.

According to a second aspect of the present invention, there is provided a fastening device with tape wherein the warp knitted tape is entirely composed of a knitting structure formed by tangling a tricot stitch yarn and a single cord stitch yarn, and a chain stitch yarn is further knitted in the fastener-molding area. Generally, stretching property is suppressed in a direction in which a sinker loop extends in a warp knitting structure. Therefore, the stretching property of the tricot stitch yarn as well as the single cord stitch yarn are suppressed in the weft direction, however, the stretching property in the warp direction is high. On the other hand, although the chain stitch yarn has a low stretching property in the warp direction, it is allowed to move freely in the weft direction. Therefore, according to the present invention, the entire warp knitted tape is formed by tangling the tricot stitch yarn and the single cord stitch yarn, and the chain stitch yarn is further knitted in the wales disposed in the center portion in the width direction of the tape, in which a fastener is to be molded.

With such a structure, while the stretching property in the warp direction is possessed at the both edge portions in the width direction of the warp knitted tape, the stretching property in the warp direction is suppressed in the center portion in the width direction of the tape. As a result, transferring and positioning of the tape are facilitated and the tape can be curved easily in the same plane, so that the tape can be sewed along the curved sewing line without difficulty, and no wrinkle occurs in the tape after the tape is sewed and the curved line along the opening/closing line of clothes never lose its shape.

According to a third aspect of the present invention, there is provided a fastening device with tape wherein the tricot stitch yarn and/or the single cord stitch yarn are knitted in close loops. As a result, deformation of a stitch of each yarn is prevented thereby leading to stabilization of an entire form of the tape.

According to a fourth aspect of the present invention, there is provided a fastening device with tape wherein the single cord stitch yarn disposed at outer wales of the attachment areas located at the both edge portions in the width direction of the warp knitted tape is a yarn thicker than the other yarns. As a result, the stitches at the outer wales of the attachment areas are made dense so as to suppress partially the stretching property in the warp direction and ensure form stability in dimension in the weft direction.

According to a fifth aspect of the present invention, there is provided a fastening device with tape wherein the warp knitted tape is entirely composed of a knitting structure formed by tangling of a two needle stitch yarn and a weft in-laid yarn, and the two needle stitch yarn disposed at the fastener-molding area is a yarn thicker than the other yarns. That is, according to the present invention, the entire tape is composed of the uniform knitting structure formed by tangling of the two needle stitch yarn and the weft in-laid yarn so as to obtain a warp knitted tape having a texture like woven fabric. As a two needle stitch yarn to be disposed in the fastener-molding area in the center portion in the width direction of the tape, a yarn thicker than the other yarns is used so as to make that portion dense, thereby suppressing the stretching property in the warp direction to a maximum extent. With such a structure, the same operation and effect as mentioned above can be secured.

According to a sixth aspect of the present invention, there is provided a fastening device with tape wherein the warp knitted tape is entirely composed of a knitting structure formed of tangling of a two needle stitch yarn and a weft in-laid yarn, and a chain stitch yarns is knitted in the fastener-molding area located at the center portion in the width direction of the tape.

As a result, the form stability in the weft direction is ensured, and in the attachment area, which is to be attached to the attachment object, disposed at the both edge portions in the width direction of the tape, the stretching property in the warp direction is ensured because of the characteristic of the two needle stitch yarn. At the same time, the stretching property in the warp direction is suppressed extremely in the fastener-molding area in the center portion in the width direction of the tape. Consequently, the same operation and effect are achieved both in a fastener-mounting-hole-forming portion and the fastener-molding portion on the tape.

DESCRIPTION OF THE EMBODIMENTS

Hereinafter, the embodiments of the present invention will be described in detail with reference to the accompanying drawings.

Figure 1:
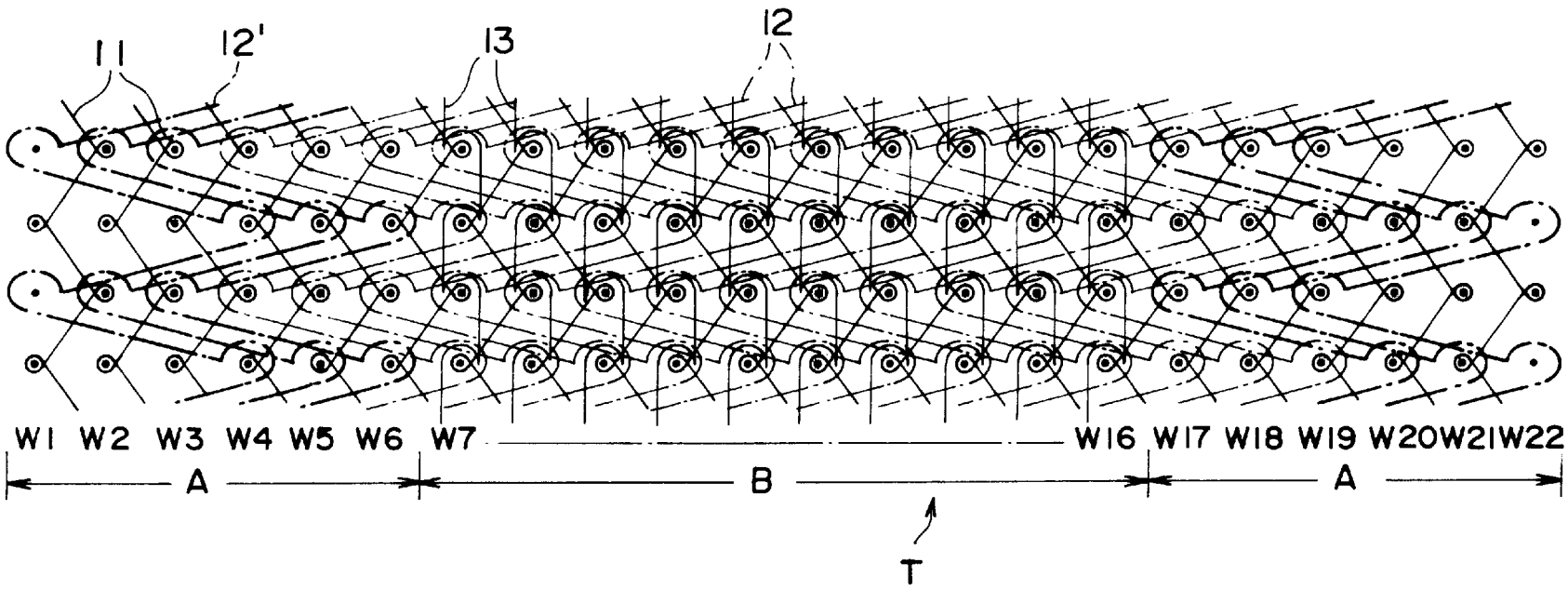
FIG. 1 is a diagram showing a knitting structure of a typical warp knitted tape which is applicable to a fastening device with tape of the present invention.
Figure 2:
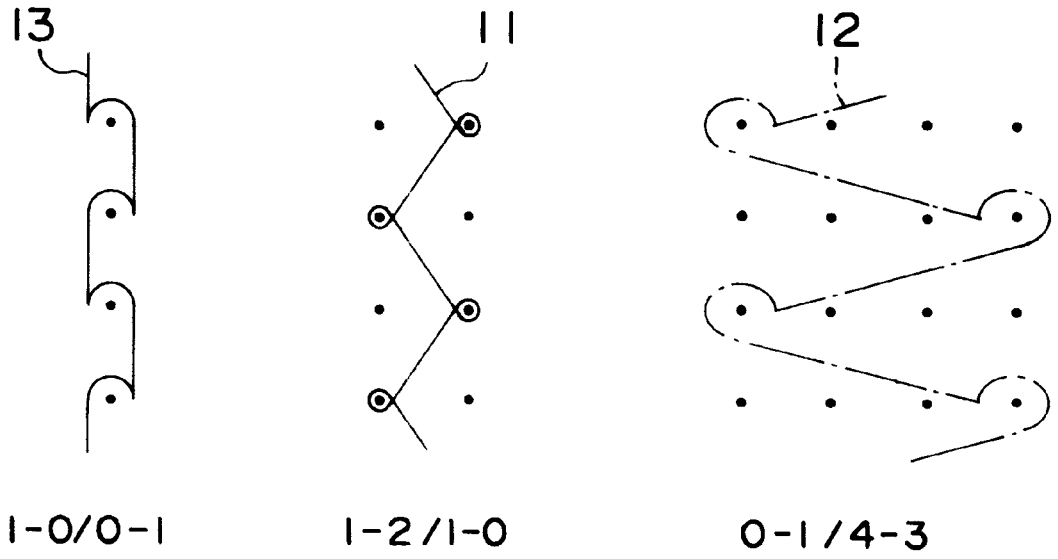
FIG. 2 is a diagram showing a knitting structure of each yarn of the warp knitted tape.

FIG. 1 is a diagram showing a knitting structure of a tape with a typical warp knitting structure which is applied to a fastening device with tape of the present invention, and FIG. 2 shows a knitting structure of each knitting yarn of the warp knitted tape.

Referring to FIG. 1, the warp knitted tape T composed of a warp knitting structure is a narrow warp knitted tape whose entire width is formed of twenty-two wales $W_1$–$W_{22}$. The six wales $W_1$–$W_6$ and $W_{17}$–$W_{22}$ at both right and left sides in the width direction of this warp knitted tape T have stretching property in a longitudinal direction of the tape T and are composed of a knitting structure having some extent of stability in dimensional form so as to form attachment areas A to be attached to an attachment object. On the other hand, the wrap knitted portion in a center in the tape width other than the attachment portion A is composed of a knitting structure having extremely suppressed stretching property in the longitudinal direction and ample stability in the dimensional form, thereby forming a fastener-molding area B.

As shown in FIGS. 1 and 2, the warp knitted tape T of this embodiment is composed of tricot stitch yarns of 1-2/1-0 and single cord stitch yarns 12 of 0-1/4-3 arranged over all the wales $W_1$–$W_2$, and chain stitch yarns 13 are knitted in ten wales $W_7$–$W_{16}$ in the center portion in the tape width direction, which is the aforementioned fastener-molding area B. Although the single cord stitch yarns 12 are knitted in open loops in the illustrated example here, they may be knitted in close loops so as to ensure stability of the stitches. This can apply to the aforementioned tricot stitch yarn 11 as well.

Further, according to this embodiment, single cord stitch yarn 12' among the single cord stitch yarns 12, which are disposed in the fastener-molding area B, are yarns thicker than the other yarns. For example when a single yarn of 100*d* multi-filament is used as any of the aforementioned other yarns, a single yarn of 200*d* multi-filament or double yarn composed of two 100*d* single yarns may be used as the single cord stitch yarn 12' to be disposed in the fastener-molding area B of the warp knitted tape T. Of course, the present invention should not be restricted to these sizes, but yarns of various sizes can be used depending on the attachment objects. When a yarn thicker than the other yarns is used, the stitches become close when the density of the knitting pattern is set equal, so that the stretching property is suppressed and the form stability is obtained.

According to the embodiment shown in FIGS. 1 and 2, by partially changing the knitting structure and the size of the yarn to be used, some extent of the stretching property in the warp direction and form stability are ensured in the warp knitted tape T.

Generally, the stretching property is low in a direction in which a sinker loop extends in the warp knitting structure. In the aforementioned warp knitting structure, each sinker loop of the tricot stitch yarns 1-2/1-0 and the single cord stitch yarns 0-1/4-3 over all the wales of the warp knitted tape T is extended obliquely in zigzag shape over multiple wales in every course. Thus, although the stretching property in the weft direction is slight, the stretching property in the warp direction is large. On the other hand, because the sinker loops of the chain stitch yarns of the fastener-molding area B disposed in the center portion in the tape width direction is extended in the warp direction along the wales, the stretching property in the warp direction is suppressed by that knitting structure.

Therefore, because only the tricot stitch yarns 11 and the single cord stitch yarns 12' are disposed in the aforementioned attachment area A according to this embodiment, the stretching property in the warp direction is ensured. Because the chain stitch yarns 13 are further knitted in addition to those knitted yarns 11, 12, the stretching property in the weft direction and the warp direction are suppressed. Further, because the single cord stitch yarns 12' disposed in the attachment areas A are composed of yarns thicker than the other knitted yarns, the stretching property in the warp direction is suppressed to some extent so as to enhance the dimensional stability.

In the warp knitted tape T of this embodiment obtained in the above manner, the attachment areas A at the right and left edge portions in the width direction of the tape T has stretching property in the warp direction as a warp knitted fabric and dimensional stability. In the fastener-molding area B in the center portion, stretching property in the warp direction is suppressed to the utmost and the form stability is also ensured.

When the fastening device with tape is manufactured with such a warp knitted tape T, for example, the production method for a fastener with tape (Japanese Patent Application No. 10-138722) as previously proposed by this inventor can be applied. Of course, as the production method, the methods as disclosed in the U.S. Pat. No. 2,821,764 and Japanese Patent Laid-Open Publication No. 62-155805 are also applicable. Further, another method for continuously producing a fastening device with tape is also applicable.

As for an ordinary production method for this kind of the fastening device with tape, for example, a long tape is supplied intermittently and fastener-mounting holes are formed at a predetermined pitch in the tape with a punch or the like. Then, the tape is inserted successively into a fastener-molding part of a molding die. As a result, a fastener of synthetic resin is molded integrally on front and rear surfaces of the tape including a periphery of the fastener-mounting hole such that the fastener-mounting hole is enclosed from inside.

Figure 3:
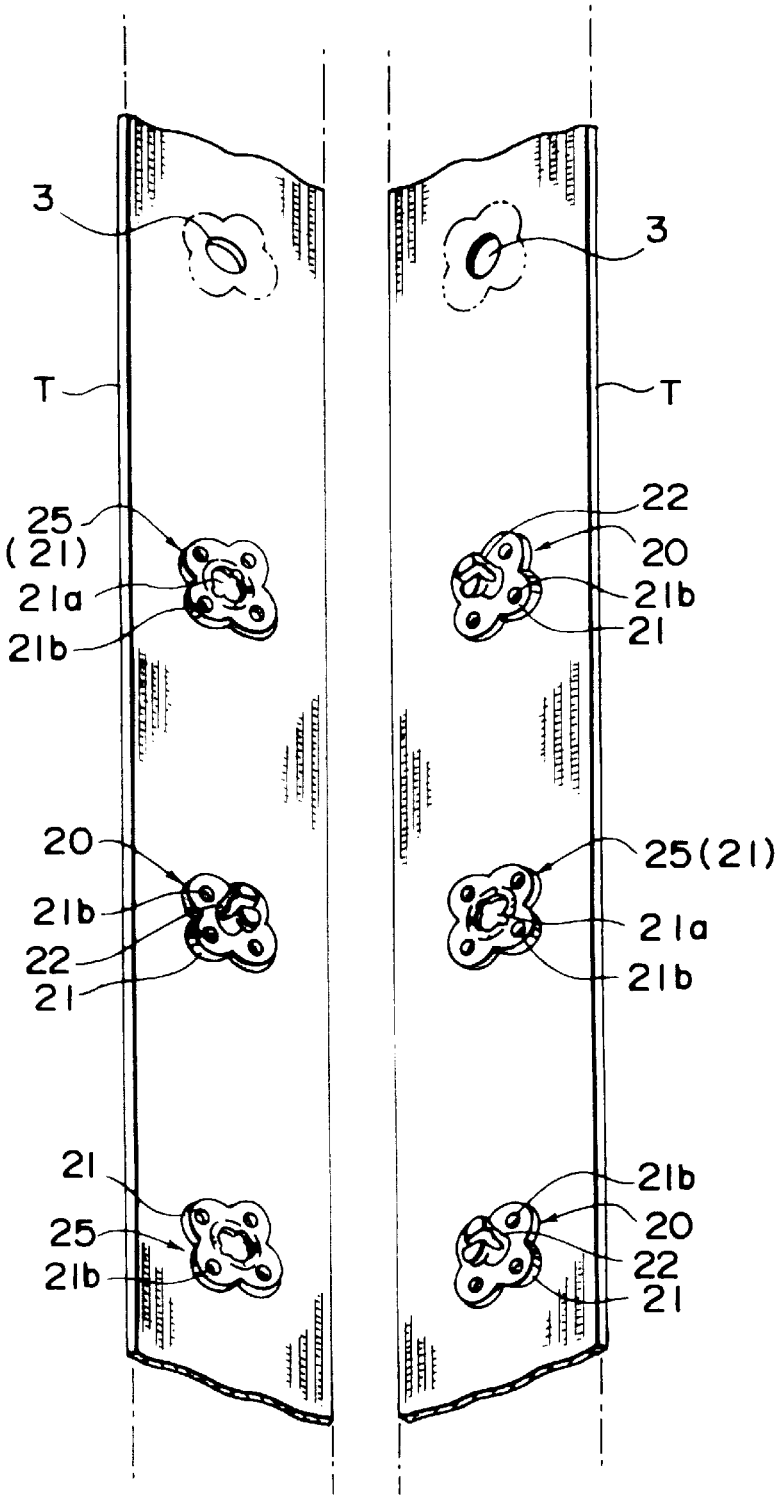
FIG. 3 is a perspective view of a snap fastener with tape showing an embodiment of the present invention.
Figure 4:
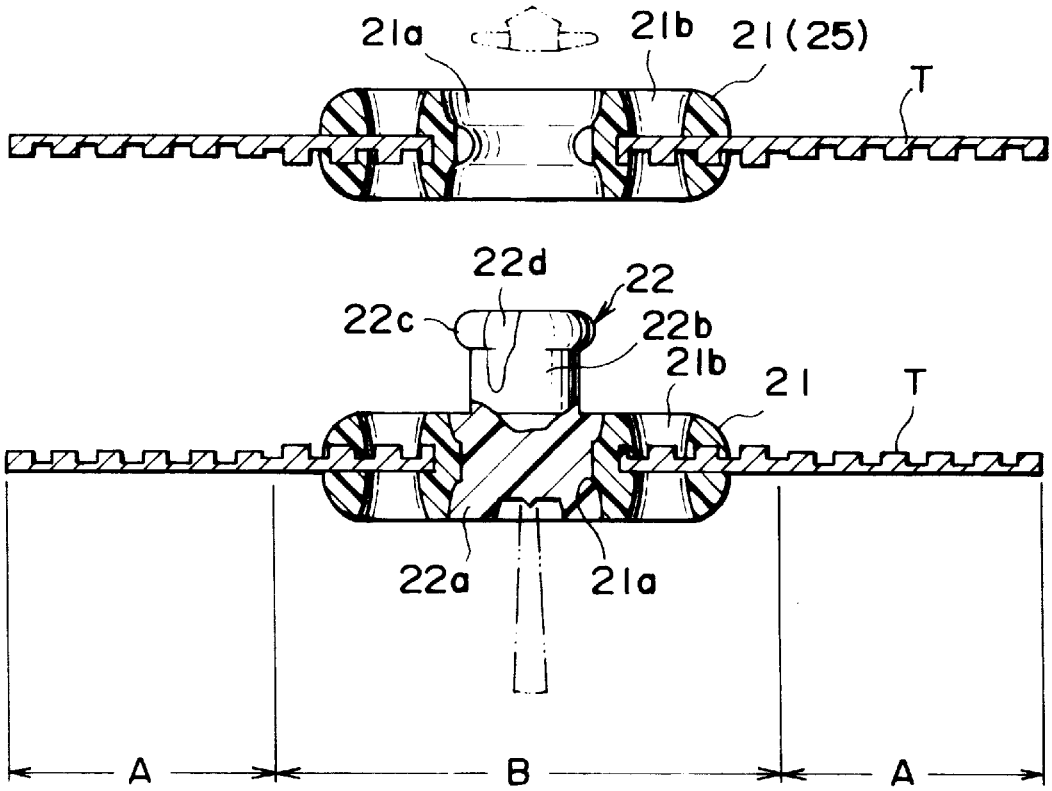
FIG. 4 is an enlarged sectional view showing an example of a structure of male and female snap fasteners in the fastening device with tape of the present invention.

FIGS. 3 and 4 show an example of a structure of a snap fastener with tape manufactured by the method according to the Japanese Patent Application No. 10-138722 as previously proposed by this inventor. As understood from the Figures, a male snap fastener 20 as a snap fastener with tape according to this embodiment comprises two members, i.e., a ring-like base member 21 and a male engaging member 22. The male engaging member 22 comprises a base portion 22*a* to be molded integrally so as to be fitted in an opening 21*a* of the base member 21, a column portion 22*b* erected from the base portion 22*a* and an engaging head portion 22*c* formed at a front end of the column portion 22*b*. According to the illustrated example shown here, the ring-like base member 21 has a structure which can be used as a female snap fastener 25 having on an inner peripheral face thereof an engaging surface for engaging and disengaging from the male snap fastener 20.

An external shape of the base member 21 entirely provides a flower-like shape in which four arc portions are connected with each other at their outer peripheries. The opening 21*a* is formed in the center of the base member 21. The mounting hole 3 of the tape T extends up to near the periphery of the opening 21*a* in the middle of the base member 21 in a direction of a thickness of the base member 21. The base member 21 is fixed integrally around the mounting hole 3 such that it encloses the periphery of the tape T around the mounting hole 3. According to this embodiment, likewise the aforementioned U.S. patent, four molding holes 21*b* are molded by clamping pins provided within the cavity and extending in the direction of the front/rear faces of the tape T. Each of the molding holes 21*b* is formed at a center of each arc portion such that its middle portion is crossed by the tape T.

Figure 5:
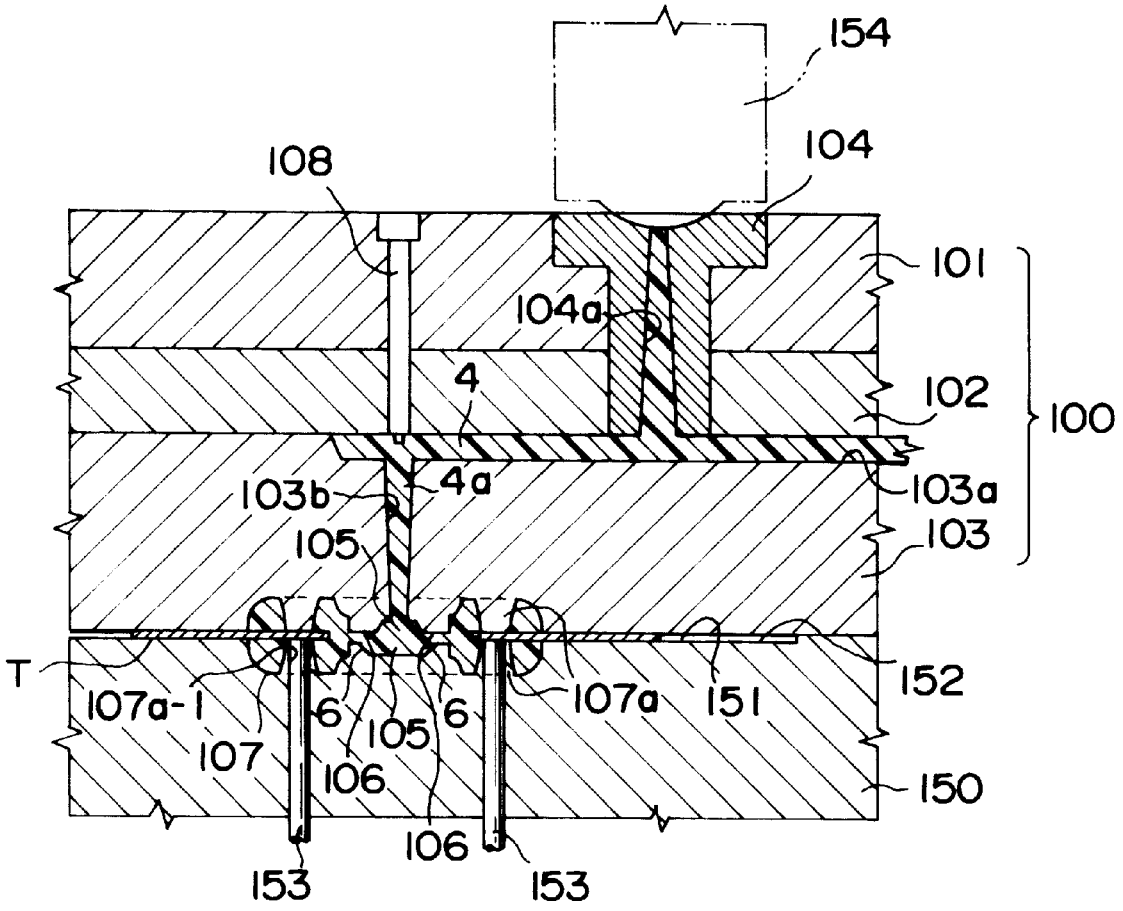
FIG. 5 is a sectional view showing an inside structure of a molding die upon manufacturing by an apparatus for manufacturing the female snap fastener with tape of the present invention.

FIG. 5 shows an example of a molding die for molding the ring-like base member 21 integrally on the tape T. According to this example, the molding die comprises a first die (movable die) 100 capable of moving vertically and a second die (fixed die) 150 disposed facing the first die 100. The first die 100 further comprises three plates 101 to 103 capable of moving vertically relative to each other. The upper plate 101 is a movable side mounting plate which is vertically movable with respect to a base frame by a lifting means (fluid pressure cylinder or the like) which is not illustrated. The middle plate 102 and the lower plate 103 are also movable vertically independently relative to the upper plate which is the movable side mounting plate 101. On the other hand, the second die 150 is composed of a single independent plate fixed on a machine base.

A substantially upper half portion of a sprue bush 104 for forming a sprue 104*a* is fixed in the movable side mounting plate 101 as in an ordinary method. A substantially lower half portion of the sprue bush 104 is slidably interfitted in a fitting hole in a stripper plate 102 which is the middle plate. A runner 103*a* communicating with the sprue 104*a* is formed in the lower plate 103 perpendicular to a transferring direction of the tape T. A sub-runner 103*b* extending vertically downward is formed at an end of the runner 103*a*. A runner lock pin 108 is mounted on an extension line of the sub-runner 103*b* in the movable side mounting plate 101 and the stripper plate 102. At a lower end of the sub-runner 103*b*, gates 106 extending horizontally via a resin reservoir portion 105 are formed on a partition surface 151 of the fixed die 150 which is the second die.

A front end portion of the gate 106 is connected to a molding cavity 107 for the base member 21 which is a female fastener. In the illustrated example, the molding cavity 107 is formed across the partition surface in the lower plate 103 and the fixed die 150 which is the second die. The resin reservoir portion 105 is also formed down to the fixed die 150. A tape-insertion passage 152 extending in the transferring direction (a direction perpendicular to a paper surface of FIG. 5) of the tape T is formed around the cavity 107 in the fixed die 150.

The base-member-molding cavity 107 is formed of a molding space of a flower shape having a substantially circular solid portion in the center thereof, with the gate 106 including the resin reservoir portion 105 being formed in the center as shown in FIG. 5. Four pairs of the pins 107*a* which are tape supporting members are disposed inside the ring-like space of the base member molding cavity 107 so as to protrude inward from above and below with a phase difference of 90°. A gap between each pair of upper and lower pins 107*a* is set at a dimension sufficient for clamping the tape T. According to this embodiment, an insertion hole for an eject pin 153 is formed in and through the pin 107*a* along an axis thereof facing the gate 106 of the fixed die 150. The eject pin 153 is slidable vertically in the pin 107*a* by an eject-pin-lifting means which is not illustrated here.

Figure 6:
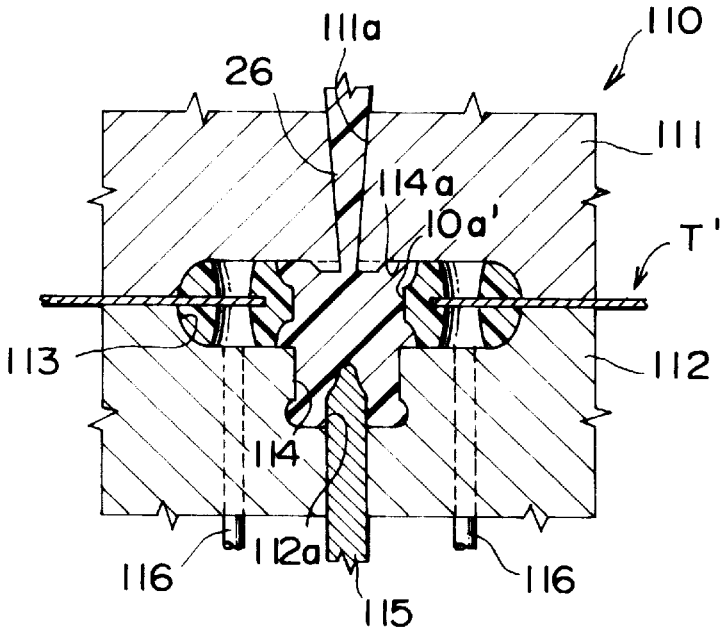
FIG. 6 is a sectional view showing an inside structure of a molding die during manufacturing the male fastening member of the snap fastener with tape of the present invention.

Although the thickness of the tape T is indicated as being uniform in FIGS. 5 and 6, actually, the fastener-molding area B in the center is thicker than the attachment area A at the right and left edge portions in the width direction of the tape T as shown in FIG. 4.

A procedure for manufacturing the tape with the base member by an injection molding apparatus having the molding die having such a structure will now be described. First, as described above, a long tape T is fed intermittently to a punching unit which is not illustrated here, while positioning of the tape T is carried out at every predetermined pitch. Then, the fastener-mounting holes 3 are formed successively at the punching unit. An injection molding unit having the aforementioned molding die is disposed adjacent the punching unit. The tape T in which the fastener-mounting holes 3 are formed is positioned such that a center of the fastener-mounting hole 3 coincides with the center of the base-member-molding cavity 107. Thus, the tape T is transferred to the injection molding unit synchronously with the punching unit.

Therefore, upon manufacturing of the tape with the base member, the positioning is carried out twice, that is, when a fastener-mounting hole 3 is formed in the long tape T being transferred and when the base member 21 is molded around the fastener-mounting hole 3. Although a high precision is required for this positioning as described above, a knitted tape having a normal stretching property is not capable of maintaining such a high positioning precision due to that stretching property. As a result, a slight displacement in position for each intermittent transfer of the tape to be processed finally leads to a large difference in position especially when the tape is long, so that a faulty product often occurs thereby disabling mass production of the same product.

However, according to the warp knitted tape T of the present invention having the above described knitting structure, in the fastener-molding area A formed at the center in the width direction of the tape T, the stretching properties in the warp and weft directions are suppressed as described above so as to ensure a dimensional stability. Therefore, no fault occurs even when a transfer system for ordinary woven tape is used as it is. As a result, a high precision is maintained regardless of the twice positionings as described above, so that no displacement is caused in the molding position of the base member 21 by continuous production of the long tape with the base member. Thus, mass production of such a tape is enabled.

The warp knitted tape T according to this embodiment is inserted into the tape-insertion passage 152 and positioned. After that, as shown in FIG. 5, with the entire die closed as shown in FIG. 5, an injection nozzle 154 of an injection apparatus is brought into contact with the sprue bush 104 and molten resin is injected. Then, molten resin is introduced through the sprue 104*a*, the runner 103*a*, the sub-runner 103*b*, the resin reservoir portion 105 and gate 106 into the base-member-molding cavity 107. Upon this injection of resin, the molten resin introduced into the cavity 107 flows from the front end of the gate 106 toward a periphery of the mounting holes 3 of the tape T. The molten resin is branched to the front and rear surfaces of the tape T so that it circulates around the upper/lower pins 107*a* disposed so as to face each other. Finally, the entire cavity is filled with the molten resin. At this time. the periphery of the tape T around the mounting hole 3 except a portion clamped by the pins 107*a* is buried integrally in the molten resin with a slight waving due to a fluid pressure of the resin.

When the injected resin is solidified by cooling, the movable side mounting plate 101 and the stripper plate 102 are raised together. With a molded runner 4 supported by the runner lock pin 108, it is disengaged from the lower-plate 103 together with the molded sub-runner 4*a*. At this time, a bottom end of the molded sub-runner 4*a* is broken from an upper end of the molded resin reservoir portion 5 and separated therefrom. Next, the stripper plate 102 moves slightly so as to release the supporting of the molded runner 4 by the runner lock pin 108, thereby removing the molded runner from the molding die together with the molded sprue portion. After this disengagement is completed, the lower plate 103 moves upward so as to open the molding die. Substantially at the same time, the eject pins 153 move slightly upward so as to push up portions of the tape T exposed in the middles of the molding holes 21*b* in the supporting pins 107*a*. As a result, the base member 21 is pushed out of the molding die together with the molded gate 6. This operation is repeated so that the tapes T' with the base member are produced continuously.

FIG. 6 shows a major part of a molding die for integrally molding the male snap fastener 20 using the tape T' with the base member produced in the above manner. In the illustrated example, an engaging member 22 is formed integrally in a central opening of the base member 21 which is also a female snap fastener 25. In the Figure, an injection molding die 110 for molding a male fastener comprises a movable die 111 and a fixed die 112 likewise the injection molding die for molding the base member. In a parting face between the movable die 111 and the fixed die 112, an accommodating space portion 113 for the tape with the base member, which serves to tightly accommodate the base member 21 and the tape T, is formed. Further, the male-engaging-member-molding cavity 114 is formed in connection with the accommodating space 113 for the tape with the base member, in order to fill the central opening of the base member 21 with the base portion 22*a* and to form the column portion 22*b* and the engaging head portion 22*c*.

Thus, in the aforementioned movable die 111, a gate 111*a* communicating with a runner which is not illustrated here is formed so as to communicate with a central portion of a base-portion-molding portion 114*a* of the male-engaging-member-molding cavity 114. A sliding path 112*a* for a sliding core 115 for dividing the column portion 22*b* and the engaging head portion 22*c* into two sections is formed in the fixed die 112. The sliding path 112*a* is formed such that the sliding core 115 is capable of sliding in a direction intersecting the fixed die 112. Further, eject pins 116 which come into contact with an outer face of the base member 21 are provided in a portion for accommodating the base member 21 inside the tape-with-base-member-accommodating space 113 of the fixed die 112 such that the pins can be lifted up/down freely.

The tape T' with the base member is inserted into the injection molding die having such a structure and set therein. When the tape T' with the base member is inserted into the tape-with-base-member-accommodating space 113 formed in the movable die 111 and the fixed die 112 and the dies are closed, the molten resin is injected in a required injection quantity. The injected molten resin is introduced into the male-engaging-member-molding cavity 114 via the gate 111*a*. When the molten resin introduced into the male-engaging-member-molding cavity 114 is solidified by cooling, the movable die 111 is raised and then, the molded male engaging member 22 is separated from the molded gate 26 by fracture. At the same time as the movable die 111 begins to open the dies, the sliding core 115 is also actuated. When this sliding core 115 is removed from the molding cavity portion of the male engaging member 22, the eject pins 116 are actuated to push a male snap fastener 20 comprising the base member 21 and the male engaging member 21 out of the fixed die 112.

Figure 9:
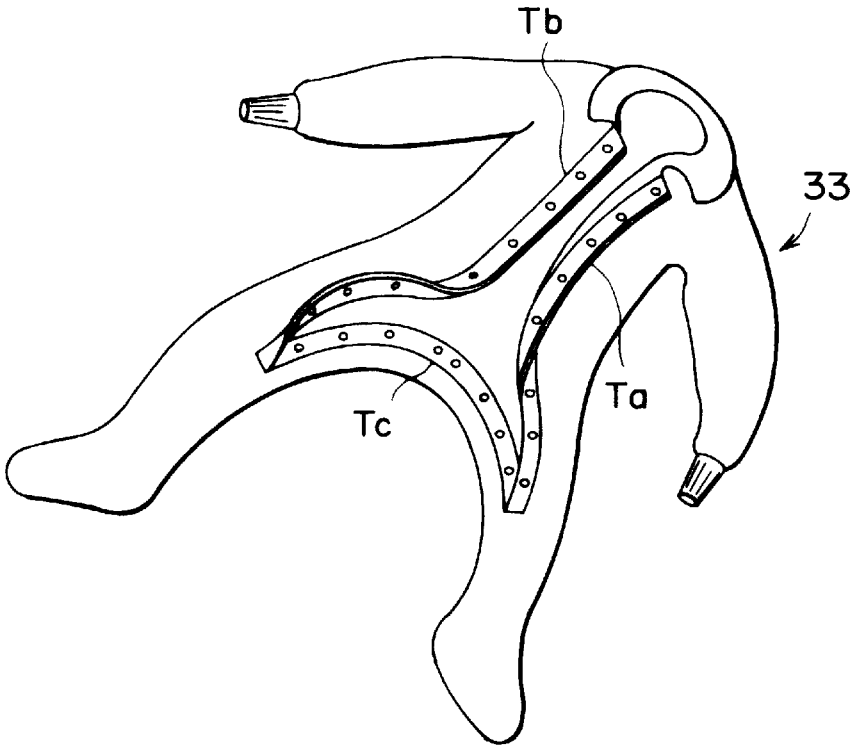
FIG. 9 is a diagram showing an appearance of an example of baby clothes to which the fastening device with tape of the present invention is attached.

In the male snap fastener with the tape obtained in the above manner, the attachment area A at the edge portions in the width direction of the warp knitted tape T is attached along an edge of an opening/closing portion of clothes (not shown) or the like. Upon this sewing, when a fastening device with tape of the above-mentioned embodiment of the present invention is sewed to curved attachment portions Ta–Tc such as a crotch portion and a front portion of a baby clothes like rompers 33 as shown in FIG. 9, the sewing work can be carried out smoothly along such curved portions, because the attachment areas A formed at both the right and left edge portions in the width direction of the tape T has stretching property in the longitudinal direction of the tape T as described above. Further even when the clothes to which the snap fastener with tape is attached is composed of knitted fabric for example, the sewing work can be carried out smoothly as described above. Further, when the engaging/disengaging operation is carried out with respect to a mating female snap fastener 25 with tape by finger, the right and left edge portions of the warp knitted tape T follow stretch of the clothes well, so that the finger force is transmitted to the engaging portion without waste. Therefore, the engaging/disengaging operation can be carried out smoothly and securely.

Figure 7:
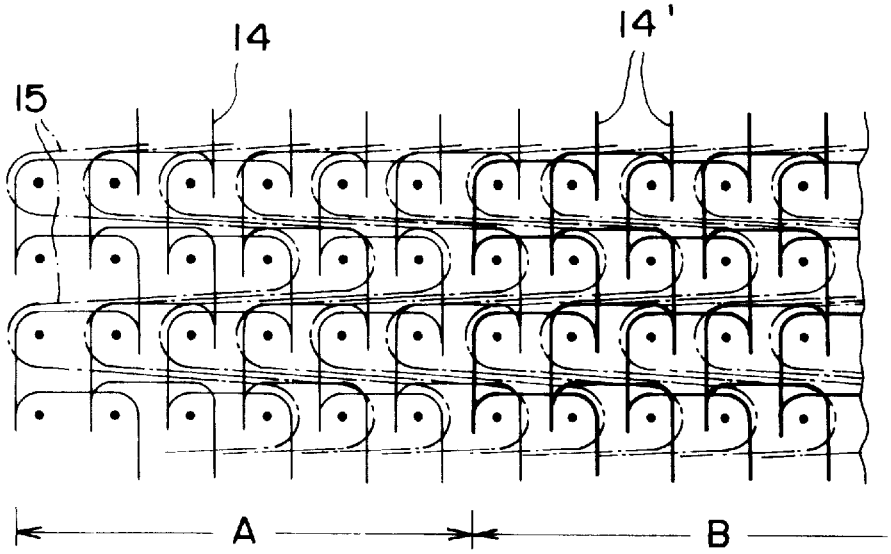
FIG. 7 is a diagram showing a knitting structure of another typical warp knitted tape which is applicable to the fastening device with tape of the present invention.

FIG. 7 shows a second example of a knitting structure for the warp knitted tape to be applied to the fastening device with tape of the present invention. In this Figure, a right half portion of the tape T is omitted while only a left half portion thereof is shown. As understood from this Figure, according to this knitting structure, the entire warp knitted tape T is composed of two needle stitch yarns 14 of 0-2/2-0 and weft in-laid yarns 15 of 0-0/4-4. A yarn thicker than the other yarns is used for the two needle stitch yarns 14' on ten wales $W_7$–$W_{16}$ of the fastener-molding area B in the center portion in the width direction of the tape T.

Consequently, the attachment area A to be attached to an attachment object formed at both the right and left edge portions in the width direction of the tape T has stretching property in the warp direction. In the fastener-molding area B formed in the center portion in the width direction of the tape T, its stitches are closer than that of the attachment area A when the density of the knitting pattern is set equal, because a thicker yarn is used for the two needle stitch yarn 14, although that area B is composed of the two needle stitch yarns 14 of 0-2/2-0 and the weft in-laid yarns 15 of 0-0/4-4 likewise the attachment areas A. Therefore, the stretching property in the warp direction is suppressed largely and its form stability is extremely secured. Although the weft in-laid yarns 15 constitute a knitting pattern of 0-0/4-4 over four wales, it may be knitted in 0-0/3-3 or 0-0/5-5 over three wales or five wales.

In producing the male fastener with tape of the present invention using the warp knitted tape T having the above described knitting structure, the warp knitted tape T is transferred intermittently while it is positioned at the punching unit and the fastener-molding part which are not illustrated here. At this time, the positioning accuracy is secured likewise that of the ordinary woven tape because the ten wales $W_7$–$W_{16}$ of the fastener-molding area B have little stretching property in the warp direction, so that the male snap fasteners 20 can be molded integrally at an accurate pitch in the longitudinal direction of the tape.

Further, when the male fastening device with tape as produced is sewed to a curved opening/closing portion of clothes or the like, it can be curved easily along the opening/closing portion because the attachment areas A at the right and left edge portions in the width direction of the tape T has stretching property in the warp direction. As a result, the sewing work can be carried out smoothly and even after the sewing, the tape T is difficult to wrinkle, so that the curve line of the opening/closing portion does not lose its shape. Because the attachment areas A and the fastener-molding area B of the warp knitted tape T have stretching property peculiar to the warp knitting structure, the tape T can following a motion of the clothes when the object clothes is flexible and has stretching property. Thus, operability by finger with respect to the male/female snap fasteners 20, 25 and transmission of the finger force are improved, the engaging/disengaging operation can be carried out easily and accurately.

Figure 8:
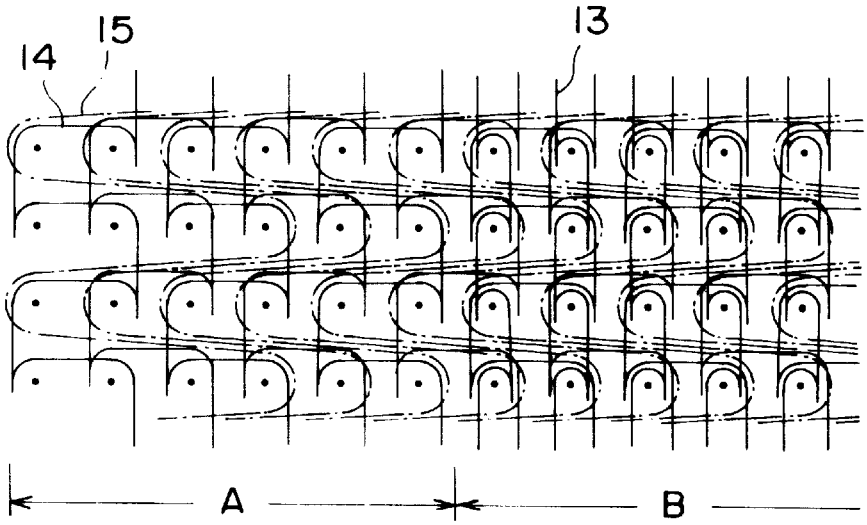
FIG. 8 is a diagram showing a knitting structure of still other typical warp knitted tape which is applicable to the fastening device with tape of the present invention.

FIG. 8 shows a third example of a knitting structure of the warp knitted tape T which is applied to the fastening device with tape of the present invention. In the Figure, a right half portion in the width direction of the tape T is omitted, and a left half portion of the knitting structure is shown. As understood from the same Figure, this knitting structure is different from the second knitting structure as shown in FIG. 7 in that the two needle stitch yarns 14 of 0-2/2-0 disposed in the fastener-molding area B formed in the center portion in the width direction of the tape T is composed of a yarn having the same size as the other yarns, and chain stitch yarns 13 are knitted in ten wales $W_7$–$W_{16}$ in the fastener-molding area B. The other knitting structure is identical with the second knitting structure.

The entire warp knitted tape T is composed of the two needle stitch yarns 14 of 0-2/2-0 and the weft in-laid yarns 15 of 0-0/4-4. In the fastener-molding area B in the center portion in the width direction of the tape T, the knitting structure in which the chain stitch yarns 13 of 1-0/0-1 are knitted as mentioned above is applied. As a result, stretching property in the warp direction is ensured in the attachment areas A formed at the right and left edge portions in the width direction of the tape T, while the stretching property of the fastener-molding area B in the center portion is suppressed extremely by the existence of the chain stitch yarns 13. At the same time, the stretching property in the weft direction is also suppressed by the aforementioned two needle stitch yarns 14 and the weft in-laid yarns 15 of 0-0/4-4. As a result, the area B is stabilized extremely in form. The knitting structure of the weft in-laid yarns 15 should not be restricted to the illustrated example shown here like the above-mentioned second knitting structure.

Consequently, in manufacturing a male fastening device with tape of the present invention, using the warp knitted tape T having such a knitting structure, high accuracy of positioning which is carried out in the punching unit and the fastener-molding apparatus which are not illustrated here when the warp knitted tape T is transferred intermittently can be ensured, because the wales $W_7$–$W_{22}$ of the fastener-molding area B in the center in the width direction of the warp knitted tape T have little stretching property in the warp direction. Further, the male fastener 20 can be molded integrally at an accurate pitch in the longitudinal direction of the tape T. Furthermore, even when a sewing line is curved when the warp knitted tape T is sewed to the attachment object, the tape T is likely to be curved along the tape surface and can be sewed neatly along the curved sewing line, because the wales $W_1$–$W_6$, $W_{16}$–$W_{22}$ disposed in the attachment areas A have stretching property in the warp direction.

Further, when the aforementioned fastening device with tape is engaged or disengaged, the male snap fastener 20 and the female snap fastener 25 can be easily set together by finger because of the flexibility peculiar to the warp knitting structure and the stretching property in the warp direction of part of the attachment areas A inside of the sewing lines. Further, the finger force can be transmitted to the snap fasteners 20, 25 securely, so that the engaging/disengaging operation can be carried out accurately and securely.

As evident from the above description, the stretching property in a warp direction of the fastener-molding area B formed in the center portion in the width direction of the tape T according to the present invention is suppressed to a maximum extent, the positioning accuracy can be secured when the same tape is transferred for producing the fastening device with tape. Further, a conventional production apparatus for the fastening device with tape of a woven fabric can be used.

When the fastening device with tape of the present invention, which is manufactured in the above manner, is attached to an attachment object such as clothes having ample stretching property, the sewing work for attachment to such flexible clothes or an attachment object having high stretching property is easy because the attachment areas A formed at the both right and left edge portions in the width direction of the tape T has stretching property in the longitudinal direction. Further, even when the sewing line is curved, the tape T itself can be curved along the sewing line, so that the tape T does not wrinkle and the sewing line does not lose its shape after the sewing.

Further, in engagement/disengagement of the fastening device with tape of the present invention after it is attached to the attachment object, when a local force is applied to the fastener-molding area B of the tape T, that portion stretches together with the attachment object, because the attachment area A between the respective sewing lines at right and left in the tape width has stretching property. As a result, the fastening device can be engaged or disengaged easily and a finger force can be transmitted to the fastening device securely so that the engaging/disengaging operation can be carried out accurately and securely.

What is claimed is:

1. A fastening device with tape obtained by molding one or more fasteners made of thermoplastic synthetic resin integrally on a tape, wherein said tape is composed of a warp knitting structure in which plural wales are disposed in a width direction of said tape, said tape having a right edge portion and a left edge portion, an attachment area for attaching an object, said attachment area formed of one or more wales disposed at said right and said left edge portions in the width direction of said tape, a fastener-molding area is an area formed of plural wales in a center in the width direction of said tape, said attachment area has a knitting structure having stretching property in a warp direction thereof, the stretching property in a warp direction thereof is created by the knitting structure and not by stretching yarns, and said fastener-molding area has a knitting structure stabilized in dimensional form while the stretching property in a warp direction thereof is smaller than the stretching property in the warp direction of said attachment area.

2. A fastening device with tape according to claim 1, wherein said tape is entirely composed of a knitting structure formed by tangling if a tricot stitch yarn and a single cord stitch yarn, and wherein a chain stitch yarn is further knitted in said faster-molding area.

3. A fastening device with tape according to claim 2, wherein at least one of said tricot stitch yarn and said single cord stitch yarn is knitted in close loops.

4. A fastening device with tape according to claim 2 or 3, wherein said single cord stitch yarn disposed at outer wales of said attachment area is a yarn thicker than the other yarns composing the tape.

5. A fastening device with tape according to claim 1, wherein said tape is entirely composed of a knitting structure formed by tangling of a two needle stitch yarn and a weft in-laid yarn, and said two needle stitch yarn disposed in said fastener-molding area is a yarn thicker than the other yarns.

6. A fastening device with tape according to claim 1, wherein said tape is entirely composed of a knitting structure formed by tangling of a two needle stitch yarn and a weft in-laid yarn, and a chain stitch yarn is knitted in said fastener-molding area.

* * * * *